United States Patent [19]

Jacobson

[11] 4,400,623

[45] Aug. 23, 1983

[54] RADIATION ATTENUATION SYSTEM

[75] Inventor: Earl B. Jacobson, McHenry, Ill.

[73] Assignee: Nuclear Power Outfitters, Crystal Lake, Ill.

[21] Appl. No.: 222,082

[22] Filed: Jan. 2, 1981

[51] Int. Cl.[3] ..... G21F 3/04

[52] U.S. Cl. ..... 250/517.1; 250/519.1

[58] Field of Search ..... 250/515.1, 516.1, 517.1, 250/518.1, 519.1; 376/293, 287

[56] References Cited

U.S. PATENT DOCUMENTS

| | | | |
|---|---|---|---|
| 3,256,440 | 6/1966 | Stark | 250/516.1 |
| 3,649,426 | 3/1972 | Gates | 250/519.1 |
| 4,090,087 | 5/1978 | Weissenfluh | 250/519.1 |
| 4,123,662 | 10/1978 | Fisher | 250/518.1 |

*Primary Examiner*—Bruce C. Anderson

*Attorney, Agent, or Firm*—Winburn & Gray, Ltd.

[57] ABSTRACT

A portable self-supporting modular radiation attenuation system formed from a plurality of modules secured to one another in any desired alignment to protect workers from radiation exposure. The modules are hollow containers shaped to mate with one another when secured thereto such as by strapping. The modules can be a single height or stacked and include ports for filling the modules with attenuation fluid when assembled and emptying them when they are to be removed. The modules mate with one another to eliminate radiation paths between the assembled modules. The modules can be formed from fiberglass and can include internal reinforcing to maintain the mating shapes.

15 Claims, 12 Drawing Figures

FIG. 1
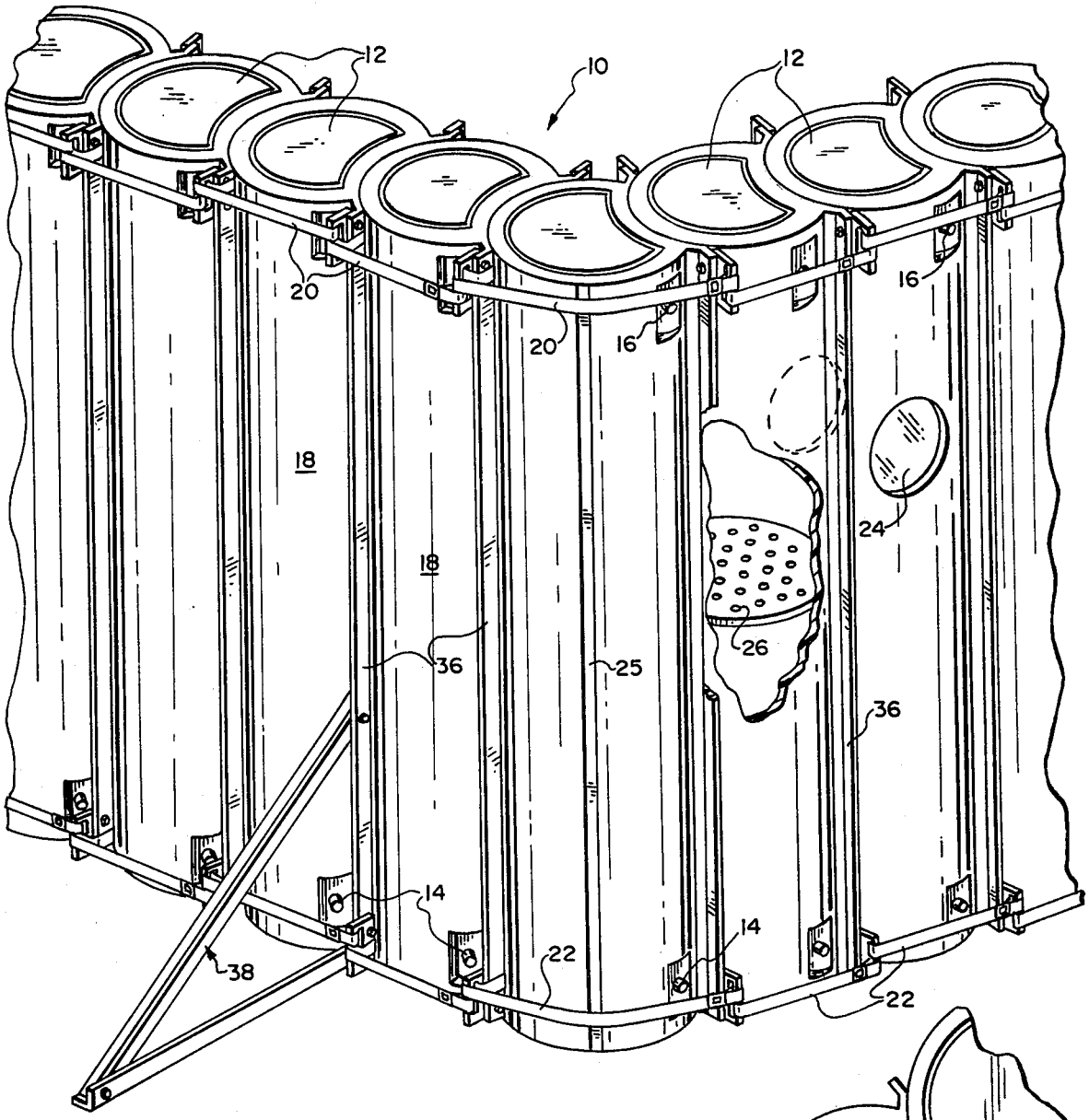
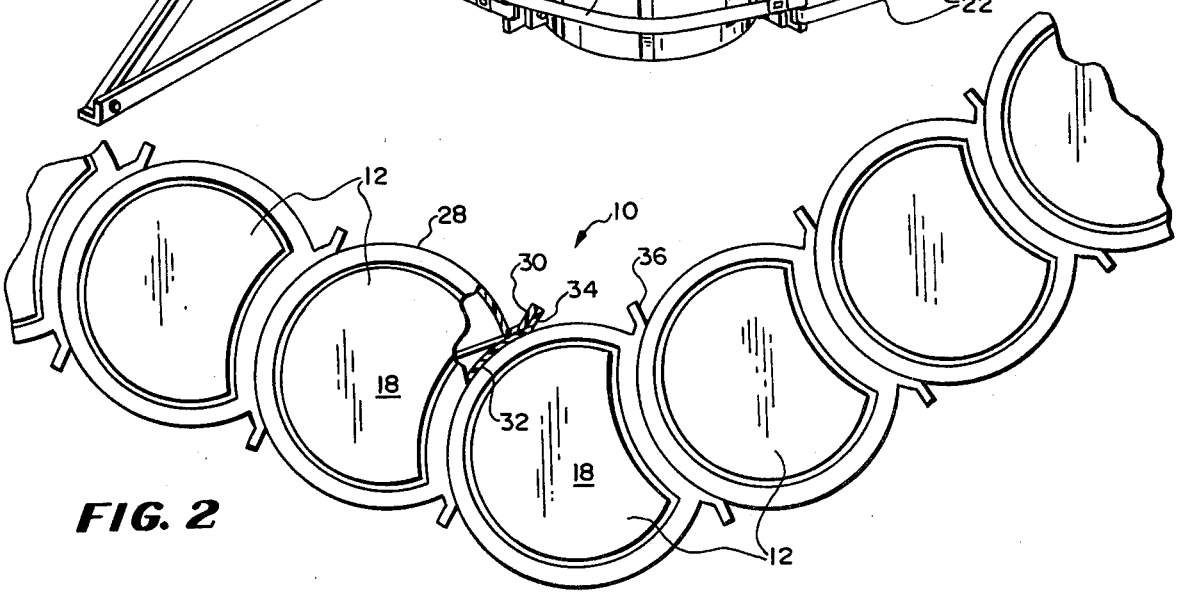
FIG. 2

FIG. 8
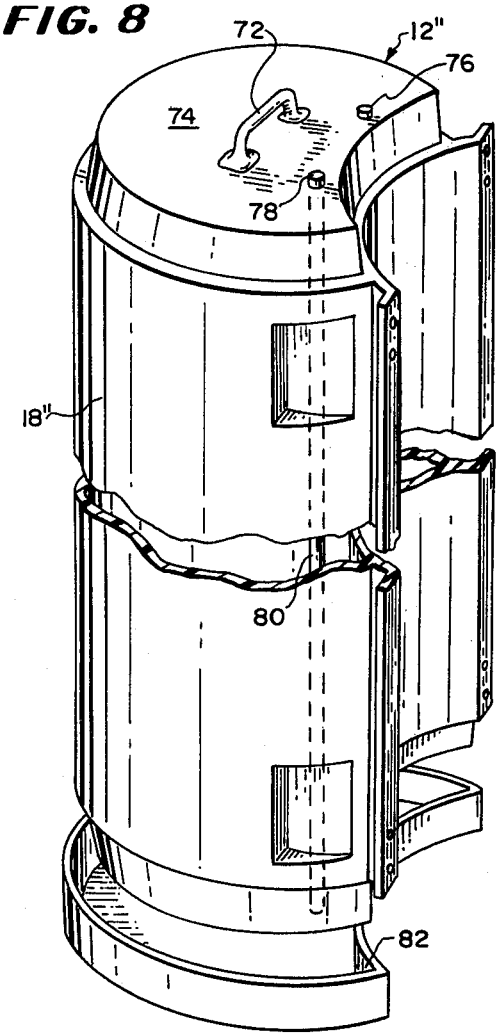
FIG. 10
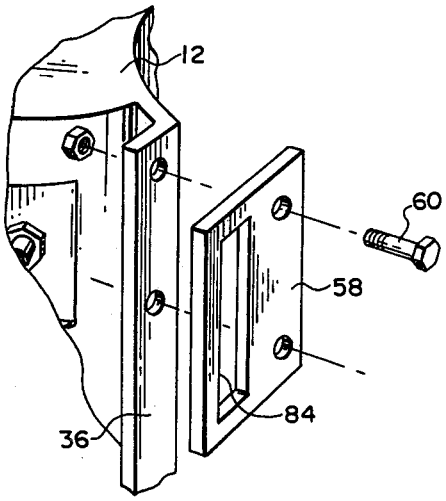
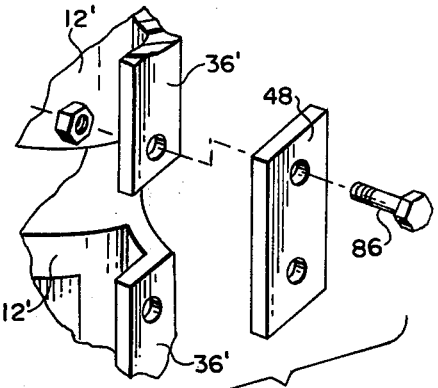
FIG. 11
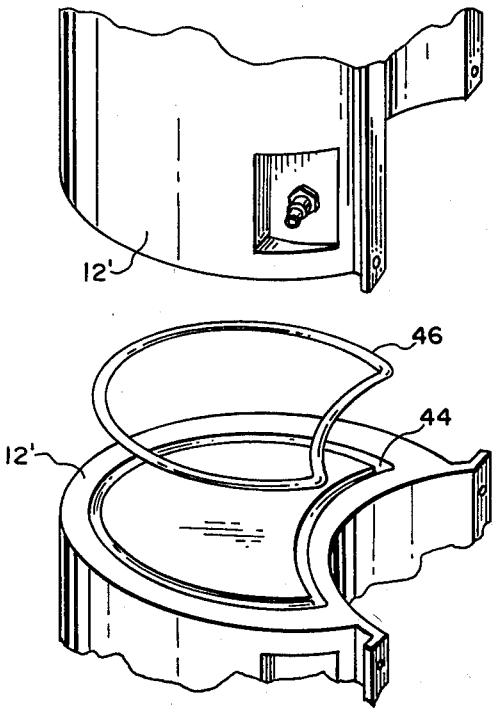
FIG. 9
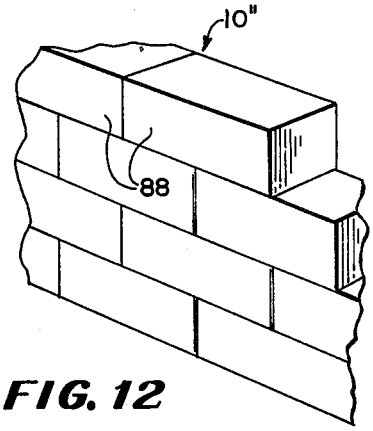
FIG. 12

RADIATION ATTENUATION SYSTEM

BACKGROUND OF THE INVENTION

The invention relates generally to radiation attenuation systems and more particularly to a modular radiation attenuation system designed to be temporarily assembled in any desired location and alignment and then filled with radiation attenuating fluid.

In nuclear power plants and in dealing with radiation wastes in general, it is desirable to be able to place a portable shielding system in place with a minimum of exposure to the workers in putting the attenuation system in place, have a maximum radiation attenuation in the system as well as ease in utilizing the system.

Each worker in a radiation emitting environment typically is attired in radiation protective clothing; however, additional shielding is desired when the workers have to be in a radiation area for any length of time. Further the amount of exposure to each worker should be as small as possible.

Attempts to reduce the radiation exposure, such as around a reactor head during refueling operations or in waste removal, have been made such as by placing lead shielding around the radiation source or providing a frame with balloon or bag type constructions which are then filled with water. Some attempts have also been made to provide large hollow shells which are then filled with a radiation attenuation fluid. These non-integrated systems have several disadvantages including exposure between the lead members or bags. These prior art units are cumbersome to work with, generally are not free standing and are not easily adaptable to the irregular work spaces which often exist in the radiation environment.

SUMMARY OF THE INVENTION

The above and other disadvantages of prior art radiation attenuation systems and techniques are overcome in accordance with the present invention by providing a self-supporting modular radiation attenuation system which easily can be assembled in any desired configuration between the radiation source and the work area. The system is formed from a plurality of radiation attenuation modules which are shaped to conform with adjacent modules when secured to one another in the desired alignment. The modules are formed from hollow containers which include entrance and exit ports for filling the containers with the radiation attenuation fluid such as water. Each module includes flexible strapping to secure it to the adjacent module when assembled in the desired alignment in relation to the radiation source. The system can include single or stackable modules.

BRIEF DESCRIPTION OF THE DRAWINGS

FIG. 1 is a partial perspective view of one embodiment of the modular radiation attenuation system of the invention with portions broken away;

FIG. 2 is a top view of a portion of the attenuation system of FIG. 1;

FIG. 8 is an exploded perspective view of one module embodiment of the radiation attenuation system of the invention;

FIG. 9 is an exploded partial perspective view of one stacking embodiment of the system modules;

FIG. 10 is an exploded partial perspective view of one strap securing plate of the shielding system;

FIG. 11 is an exploded partial perspective view of one coupling plate of the shielding system; and FIG. 12 is a partial perspective view of another embodiment of the modular radiation attenuation system of the invention.

DESCRIPTION OF THE PREFERRED EMBODIMENTS

Figure 3:
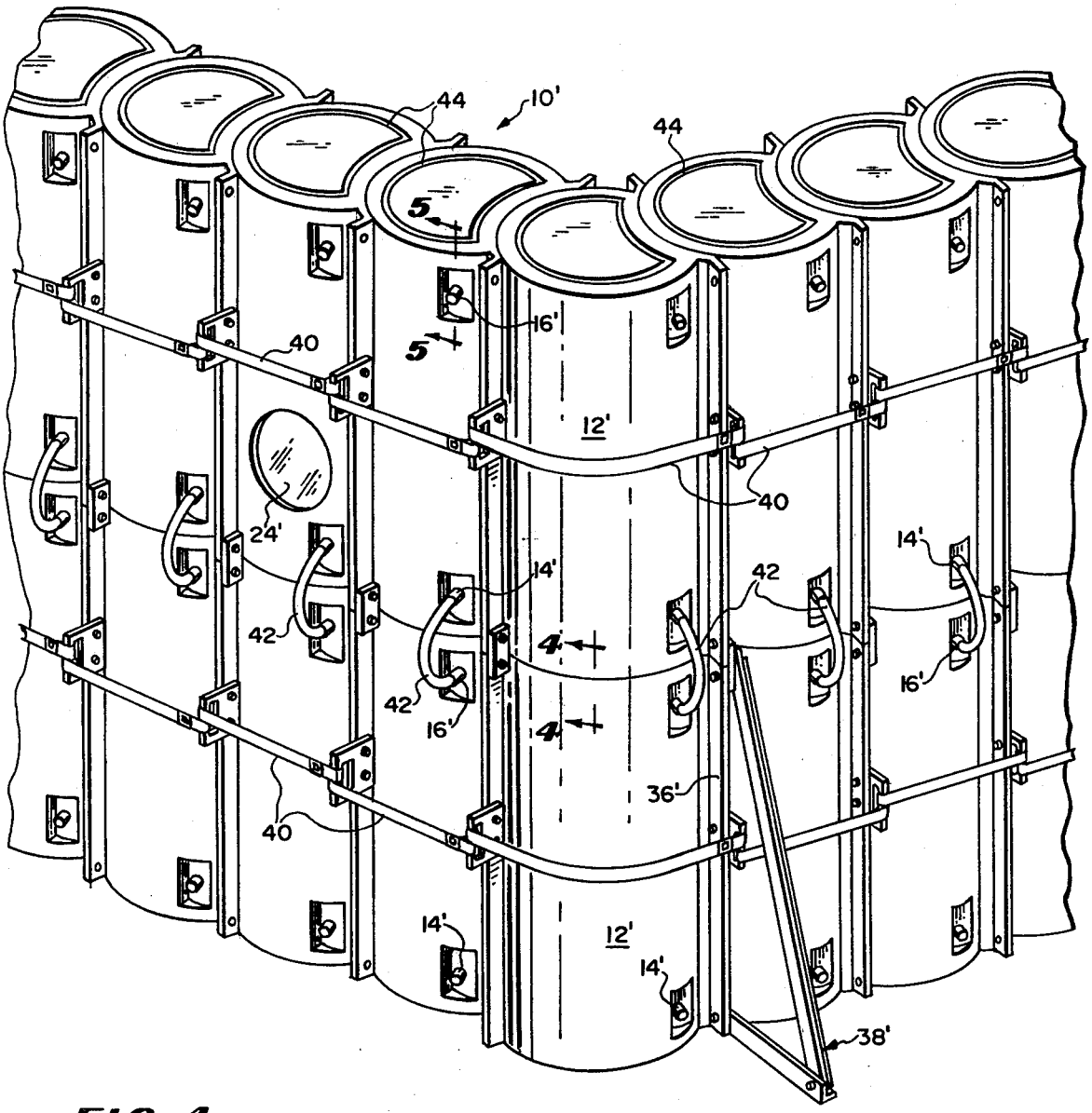
FIG. 3 is a perspective view of a second embodiment of the modular radiation attenuation system of the invention.

Referring to FIGS. 1 and 2, a modular radiation attenuation system embodying the invention is designated generally by the reference numeral 10. The modular radiation attenuation system or radiation attenuator 10 is shown assembled in an angular configuration and includes a plurality of modules 12. Each module 12 includes at least two ports 14 and 16 which are utilized to fill and empty the modules 12 with radiation attenuating fluid. Each module 12 includes a container body 18 shaped to conform to the body 18 of an adjacent module.

Each module 12 includes a pair of top straps 20 and a pair of bottom straps 22 which are secured to the adjacent module 12 to assemble the radiation attenuator 10. Once the modules 12 are assembled with their respective straps 20 and 22 in the desired alignment between the work space and the source of radiation, each of the containers 18 can be filled through the ports 14 and 16 which can be coupled together in a manifold type system with the filling and emptying done from a remote position.

One or more of the modules 12 can include a viewing port 24 which can be utilized by a worker to observe the radiation area on the opposite side of the radiation attenuator 10.

One or more of the modules also can include a semi-transparent strip 25 which can be monitored to make sure the system 10 is completely filled with fluid. Alternately, an external level indicating tube or device can be utilized. The fluid can contain a coloring agent to assist in visually determining the fluid level in the system. The modules 12 also can include an internal grid plate 26 which adds structural strength to the modules 12.

Each module 12 includes a substantially rounded convex portion 28 which terminates in an outwardly turned flange 30. A second concave portion 32 conforms to the shape of the rounded portion 28 of the adjacent module 12. The concave portion 32 includes a flange piece 34 which is welded or otherwise secured to the flange piece 30 to form an integral extending flange 36 on opposite sides of each module 12. The flange 36 may include a brace 38 where necessary or desired. If the radiation attenuator 10 is aligned in one or more bends or otherwise is aligned in other than a substantially straight line the braces 38 can be eliminated.

A second embodiment of attenuator 10' with stacked modules 12' is best illustrated in FIG. 3. The modules 12 (FIG. 1) can be six or eight feet tall and hence do not need to be stacked to protect the workers. The modules 12' may be smaller units which are stacked to form the radiation attenuator 10'. The modules 12' can include a single pair of straps 40. Braces 38' can be utilized as desired. The upper port 16' and the lower port 14' can be connected by a flexible tubing 42 to allow each pair of stacked modules 12' to be filled and emptied together. In a like manner each pair of the stacked modules 12' can be coupled together in a single manifold system where desired. Each module 12' is substantially identical and can be the top or bottom module.

Figure 4:
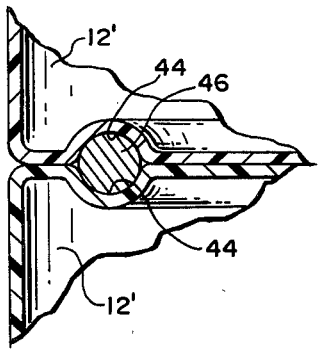
FIG. 4 is a partial side section view of two modules of the system of FIG. 3 taken along the line 4—4 therein.

To assist in stacking the modules 12' to one another a groove or indentation 44 can be formed in the top and bottom of each of the modules 12', as best illustrated in FIG. 4. The grooves 44 mate with one another when the modules 12' are stacked upon one another and can include a gasket 46 inserted therein to assist in aligning and securing the modules 12' to one another. The modules 12' also preferably are connected together by pairs of securing plates 48 (FIG. 3) which are connected to the stacked modules 12' through the respective flanges 36".

Figure 5:
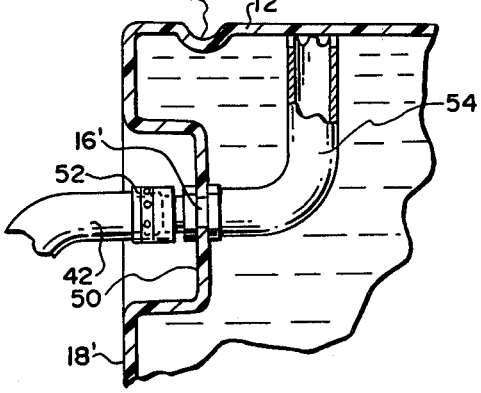
FIG. 5 is a partial side sectional view of one module port of the system of FIG. 3 taken along the line 5—5 therein.

Referring now to FIG. 5, a top port 16' is illustrated which is formed in an indentation 50 in the container 18' to eliminate damage to the fitting 52 forming part of the port 16'. The port 16' includes an inner tube 54 which can be a J-type tube to ensure that the attenuation fluid 56, such as water, will fill the module 12' completely. The bottom pot also contains the J-type tube to completely empty the module.

Figure 6:
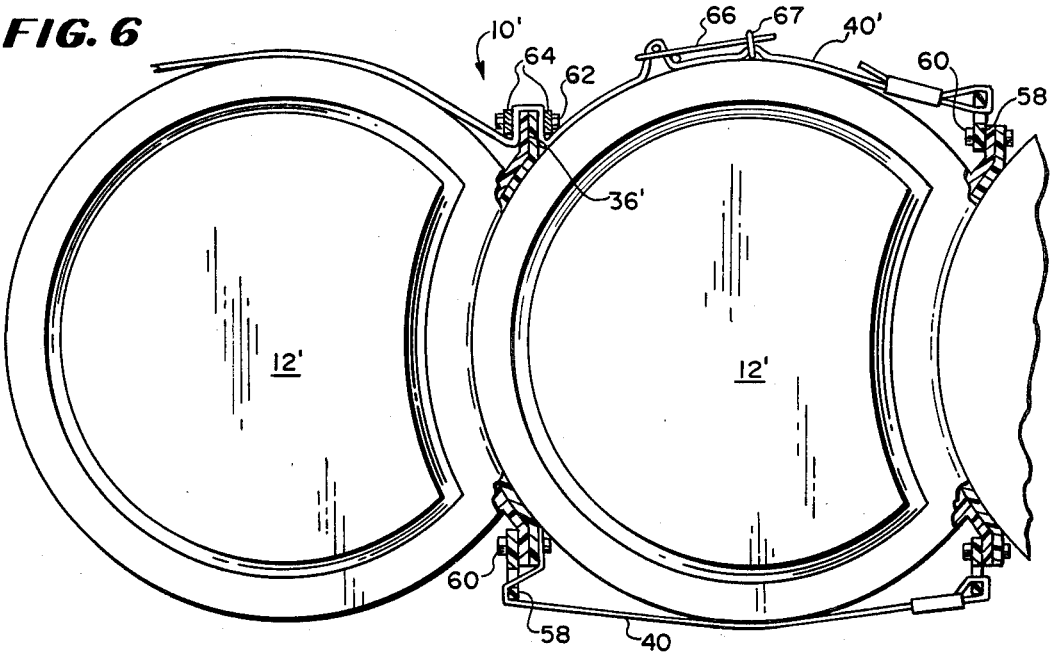
FIG. 6 is a partial top sectional view of the system illustrating one embodiment of module securing means.

Referring to FIG. 6, the securing of the modules 12' (or modules 12) is best illustrated. The straps 40 are secured through mounting plates 58 mounted by bolts 60. Alternately, an adjustable strap 40' can be bolted by a bolt 62 through a pair of mounting plates 64 securing the strap 40' to the flange 36'. The end of the strap 40' then is inserted through the mounting plate 58, tightened by a lever 66 and secured by a fastener 67 in a conventional manner.

Figure 7:
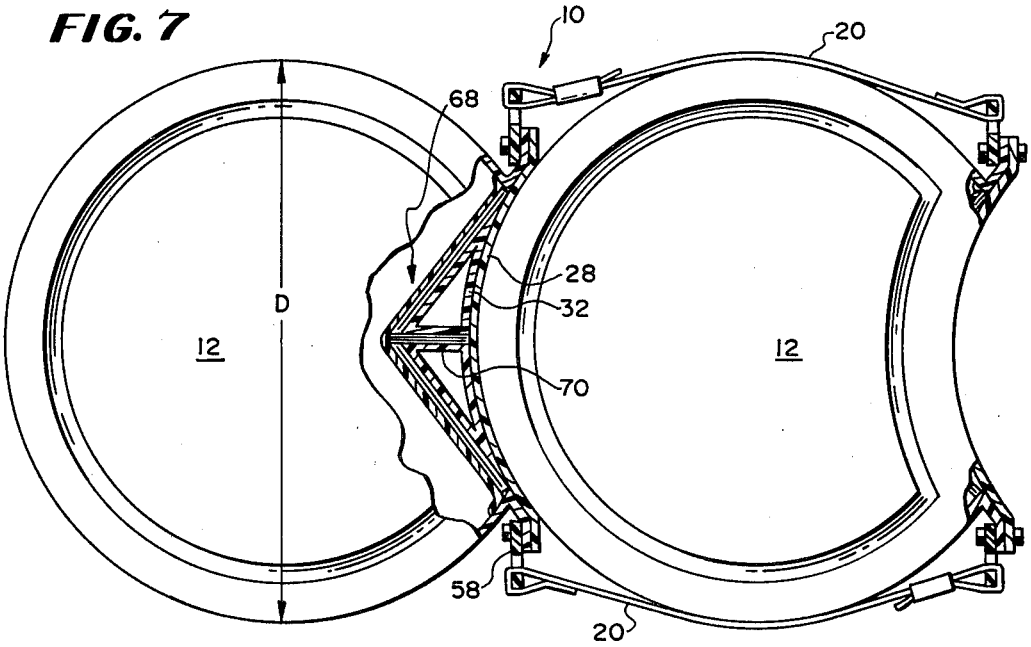
FIG. 7 is a partial top sectional view of the system illustrating the internal reinforcement portion of one module.

The internal structure of one of the modules 12 (or 12') is illustrated in FIG. 7 which includes a reinforcing member 68. The triangular shaped member 68 has a center support rib 70 which runs the length of the module 12. The member 68 with the rib 70 maintains the concave shaped portion 32 so that the modules 12 or 12' can be secured in any alignment desired without a direct radiation path between adjacent modules 12 or 12'. The modules 12 or 12' can have a diameter D of about two feet which provides at least a ten fold reduction in transmitted radiation when filled with water.

Referring now to FIG. 8, a second embodiment of a non-stackable module 12" is illustrated. The container body 18" can include a handle 72 formed or secured to a top member 74 of the container 18". The top member 74 can be a cap type member which is inserted over the exposed ends of the body 18" in manufacturing the body to form the container 18". The top also includes an entrance port 76 and an exit port 78 which would replace the ports 14 and 16 illustrated in FIG. 1. The port 78 would be connected to a tube 80 which extends substantially to the bottom of the container 18" so that the container can be completely emptied of the attenuation fluid when desired.

To facilitate aligning the modules 12" in the modular radiation attenuation system a hub or pan 82 can be utilized to form the pattern for the system alignment prior to inserting the modules 12" in position. The hubs or pans 82 have a configuration conforming to that of the outside of the bottom of the container 18" and can be secured to the floor or one another to provide the proper alignment. In a like manner the hubs or pans 82 also can be utilized, with appropriate openings, on the tops of the modules 12" to aid in securing the modules 12" in their proper position.

The gasket 46 described in FIG. 4 is illustrated in FIG. 9. The gasket 46 can be an elastomeric type member which aids in aligning and securing the top module 12' when the system 10' is being assembled.

The modules 12 or 12' can include one or more of the strap mounting plates 58 (previously described) as illustrated in FIG. 10. The plates 58 are secured to the flange 36 by bolts 60. The plates 58 include an opening 84 through which the straps or other securing means are passed to secure the modules to one another in the assembled system.

The stacked modules 12' are secured to one another by the securing plates 48 best illustrated in FIG. 11. The plates 48 are secured to the respective top and bottom module flanges 36' by bolts 86. If the modules 12' are formed with the top and bottom caps 78 (similar to those illustrated in FIG. 8), then the plates 48 will be extended across the gap between the ends of the flanges 36".

FIG. 12 illustrates another embodiment of the radiation system 10". The system 10" includes a plurality of modules 88 which can be hollow block type containers. The modules 88 can then be stacked where desired. The containers 88 are most suited for use in a straight line to minimize the gaps between the modules 88.

Many modifications and variations of the present invention are possible in light of the above teachings. The modules can have numerous shapes such as triangular. The fitting 52 can be a flexible quick-disconnect fitting for easy connection between the stacked modules 12'. The attenuation system preferably is a rigid self supported structure made out of a fiberglass type material or other material which does not generate secondary emissions from exposure to radiation. The material can be fiberglass, plastic or any molded polyethylene light weight material which has sufficient strength and rigidity. The material preferably would be reinforced fiberglass which has the same attenuation characteristics as water, such as the type utilized in road trailer bodies. The flange 36 can be molded or made by gluing or riveting the flanges 30 and 34. The port 24 can be formed from plexiglass. The attenuation liquid can be water or can be other liquid such as boron and may include antifreeze or a heater to prevent the fluid from freezing if it is in a non-heated environment. It is, therefore, to be understood that within the scope of the appended claims, the invention may be practiced otherwise than as specifically described.

What is claimed and desired to be secured by Letters Patent of the United States is:

1. A self-supporting modular radiation attenuation system comprising:

a plurality of interengaging radiation attenuation module elements, each element adapted to be substantially filled with a radiation attentuating fluid when positioned where desired;

each of said module elements including complementary interengaging surface portions configured to nest within a substantially complementary portion of an adjacent module to substantially eliminate when assembled directed radiation paths between assembled module means while accommodating substantial nested cumulative misalignment; and each of said module means including retention means adapted for securing said module means to one another in any desired alignment within the limits of said nested relationship, whereby said elements may be arranged with respect to each other to accommodate and shield an irregular surface.

2. The radiation attenuation system according to claim 1 wherein:

said assembly means include at least a pair of straps; and a pair of mounting means each including an opening adapted to pass a strap from an adjacent module means therethrough to secure said module means to one another.

3. The radiation attenuation system according to claim 1 wherein:

at least one of said module means include viewing port means.

4. The radiation attenuation system according to claim 1 wherein:

at least one of said module means include means for indicating the fluid level in said module means.

5. The radiation attenuation system according to claim 1 wherein:

each of said module means include means adapted to stack said module means one on top of another.

6. The radiation attenuation system according to claim 1 wherein:

said module means include internal reinforcing means.

7. The radiation attenuation system according to claim 1 wherein:

said module shaped means include an elongated body which includes a concave surface on a portion of said body and a conforming convex surface on a second portion of said module means.

8. The radiation attenuation system according to claim 1 wherein:

said module means include internal reinforcing means.

9. The radiation attenuation system according to claim 8 wherein:

said reinforcing means extend substantially the length of said body on the inside of said concave surface to maintain said shape.

10. The radiation attenuation system according to claim 1 wherein:

said module means include port means for filling and removing the fluid from said module means.

11. The radiation attenuation system according to claim 10 wherein:

said port means include means for substantially completely filling and substantially completely emptying said module means.

12. The module according to claim 1 wherein:

said container body is an elongated body which includes a concave surface on a portion of said body and a conforming convex surface on a second portion of said body.

13. The module according to claim 1 wherein:

said body includes internal reinforcing means.

14. The module according to claim 1 wherein:

said reinforcing means extend substantially the length of said body on the inside of said concave surface to maintain said shape.

15. The module according to claim 1 wherein:

said port means include means for substantially completely filling and substantially completely emptying said body.

* * * * *